US012064676B2

(12) United States Patent
Foster

(10) Patent No.: US 12,064,676 B2
(45) Date of Patent: Aug. 20, 2024

(54) DEFENSIVE LINE SHOOT DRILL APPARATUSES AND METHODS

(71) Applicant: Roderick Foster, Abernant, AL (US)

(72) Inventor: Roderick Foster, Abernant, AL (US)

(73) Assignee: Gridzozo, Inc., Richmond, VA (US)

( * ) Notice: Subject to any disclaimer, the term of this patent is extended or adjusted under 35 U.S.C. 154(b) by 0 days.

(21) Appl. No.: 17/527,662

(22) Filed: Nov. 16, 2021

(65) Prior Publication Data

US 2022/0152467 A1 May 19, 2022

Related U.S. Application Data

(60) Provisional application No. 63/204,545, filed on Nov. 18, 2020.

(51) Int. Cl.

| | |
|---|---|
| ***A63B 69/34*** | (2006.01) |
| ***A63B 69/22*** | (2006.01) |
| ***A63B 71/02*** | (2006.01) |

(52) U.S. Cl.

CPC ..... *A63B 69/34* (2013.01); *A63B 69/222* (2022.08); *A63B 71/03* (2020.08); *A63B 2243/007* (2013.01)

(58) Field of Classification Search

CPC .... A63B 69/34; A63B 71/03; A63B 2243/007
See application file for complete search history.

(56) References Cited

U.S. PATENT DOCUMENTS

| | | | | | |
|---|---|---|---|---|---|
| 1,708,638 | A * | 4/1929 | Smith | A63B 69/34 | 473/442 |
| 2,532,880 | A * | 12/1950 | Banbury | A63B 69/34 | 473/443 |
| 2,602,666 | A * | 7/1952 | Burke | A63B 69/34 | 248/289.11 |
| 3,451,677 | A * | 6/1969 | Nedwick | A63B 69/34 | 473/440 |
| 3,547,438 | A * | 12/1970 | Schmitter | A63B 69/34 | 473/443 |
| 3,578,323 | A * | 5/1971 | Coleman | A63B 69/00 | 473/438 |
| 3,658,332 | A * | 4/1972 | Adduci | A63B 69/34 | 473/443 |
| 4,218,060 | A * | 8/1980 | Forrest | A63B 69/34 | 473/438 |
| 4,688,795 | A * | 8/1987 | Callaway, Jr. | A63B 69/34 | 473/438 |
| 4,736,947 | A * | 4/1988 | Jenkins | A63B 69/34 | 273/DIG. 26 |
| 8,790,198 | B1 * | 7/2014 | Russell | A63B 69/244 | 473/422 |
| 2014/0315665 | A1 * | 10/2014 | Hall | A63B 69/34 | 473/445 |
| 2014/0357430 | A1 * | 12/2014 | Bognanno | A63B 69/34 | 473/442 |

* cited by examiner

*Primary Examiner* — Joshua T Kennedy
(74) *Attorney, Agent, or Firm* — Dennen IP Law, LLC

(57) ABSTRACT

An apparatus has a front, lower section and a back, higher section coupled to the front, lower section and coupled to a dummy, such that a football player can strike a three-point stance under the front lower section, move outward and upward, and tackle the dummy.

13 Claims, 3 Drawing Sheets

DEFENSIVE LINE SHOOT DRILL APPARATUSES AND METHODS

CROSS-REFERENCE TO RELATED APPLICATION

The present application claims priority to U.S. Provisional Patent Application Ser. No. 63/204,545 entitled Proposal for Defensive Line Shoot Drill 2019 and filed on Nov. 18, 2020, which is incorporated herein by reference.

BACKGROUND

A defensive lineman often uses hands to stop a chop block to block an offensive player. The legal variety is used within 3 yards of the line of scrimmage to slow the opposition's pass rush. A defensive lineman stays down low with his shoulders and arms, attempting to stop the offensive lineman's momentum.

BRIEF DESCRIPTION OF THE DRAWINGS

A defensive line shoot drill apparatuses and methods are described with reference to the accompanying drawings. In the drawings, like reference numbers indicate identical or functionally similar elements.

DETAILED DESCRIPTION

A defensive line shoot drill apparatus in accordance with an embodiment of the present disclosure is shown herein. The line shoot drill apparatus is made for training defensive lineman. However, it is use is not limited to such.

The defensive line shoot drill apparatus comprises a first level under which the football player starts the drill. Further, the line shoot drill apparatus comprises a second level that is taller than the first level and is coupled to a hanging dummy. From underneath the first level, the football player shoots out and aims to strike the dummy or tackle. Starting under the lower level helps the defensive lineman stay down low with his shoulders and arms. Specifically, the defensive line shoot drill teaches the defensive lineman to use his arms to tackle and strike.

Figure 1:
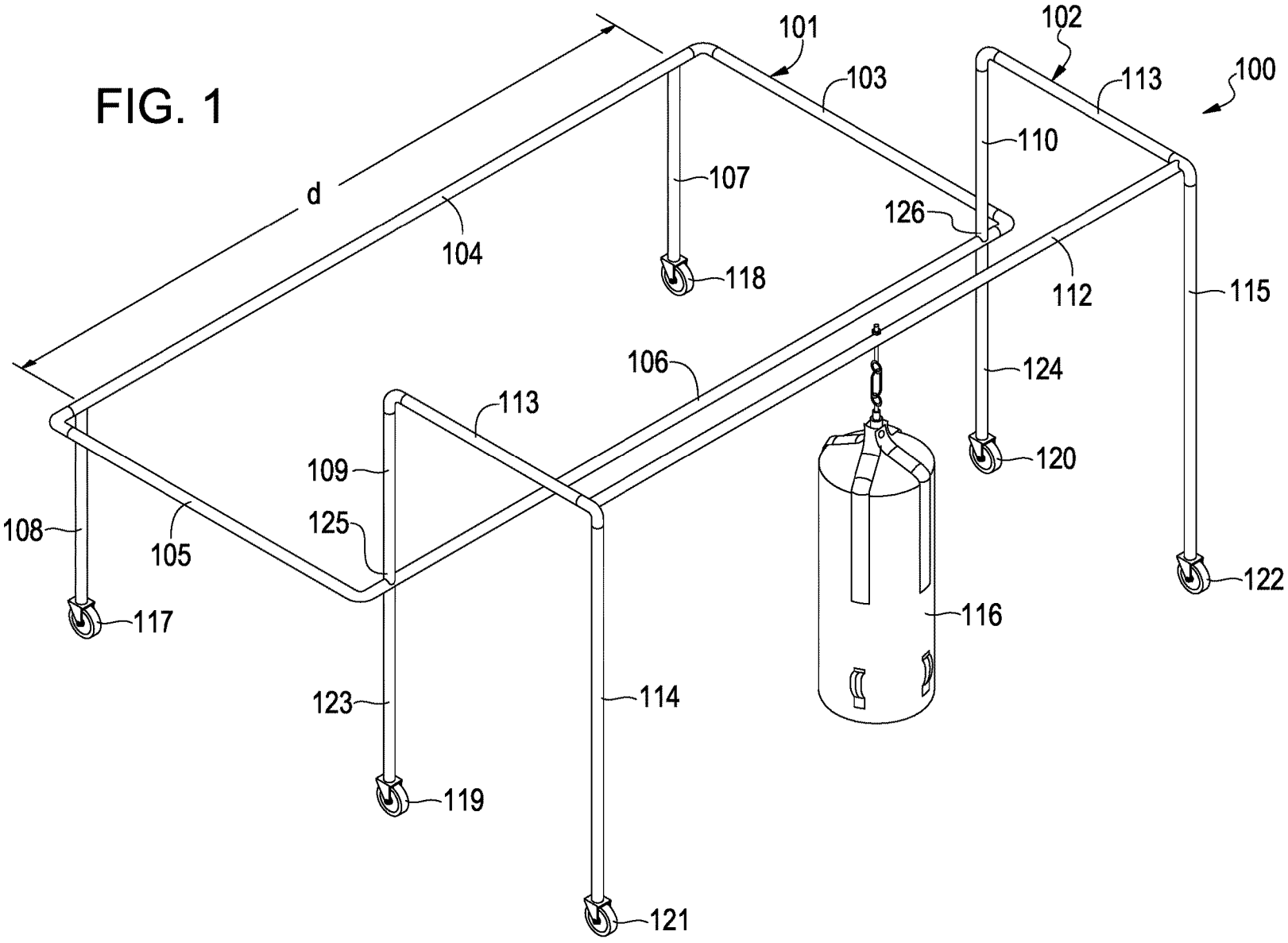
FIG. 1 is a perspective view of an exemplary defensive line shoot drill apparatus in accordance with an embodiment of the present disclosure.

FIG. 1 is an exemplary defensive line shoot drill apparatus 100 in accordance with an embodiment of the present disclosure. The defensive line shoot drill apparatus 100 comprises a front, lower section 101 and a back, higher section 102. In operation, the football player gets in a three-point stance beneath the front, lower section 101. In this stance, the football player (not shown) places weight on the balls of his feet leaning slightly forward.

When signaled, the football player moves forward and upward underneath the back, higher section 102. In so doing, the football player tackles or strikes the dummy 116 with his hands. Note that as the football player moves from underneath the front, lower section 101 to the back, higher section 102, the football player is positioned to hit low and upward on the dummy and to use his arms in the tackle. This exercise trains the football player to come out of his stance and hit low and upward on an offensive lineman.

The front, lower section 101 is cuboidal-shaped. In this regard, the front, lower section 101 comprises a top rectangular shape made up of two short parallel tubes 103 and 105 and two long parallel tubes 104 and 106. The short tube 103 is coupled at corners to the longer tubes 104 and 106. Further, the short tube 105 is coupled at corners to the longer tubes 104 and 106. Tubes 103-106 form and open rectangle.

Coupled to and extending down from tube 104 are legs 107 and 108. Legs 107 and 108 are separated by a distance d. The legs 107 and 108 support the rectangular, front, lower section 101 off the ground (not shown).

The back, higher section 102 couples to the front, lower section 101. In this regard, the back, higher section 102 comprises legs 109, 123,110, and 123. Note that 109 and 123 are separate rods that couple at 125 and are held together with a pin, for example. Further, 110 and 123 are separate rods that couple at 126 and are held together with a pin, for example. The legs 109, 123 and 110, 124, couple to the long tube 106 and legs 123 and 124 extend down to the ground.

Coupled to the top of the legs 109 and 110, are short, parallel tubes 113 and 111, respectively. Further, the parallel tubes 113 and 111 are coupled together by a back tube 112. There is no parallel pole to pole 112 to leave an area for the football player to move upward and outward to contact the dummy 116.

Parallel to legs 109 and 110 are legs 114 and 115. Legs 114 and 115 extend downward from the back tube 112 to support the back, higher section 102.

Note that on any tube that extends to the ground, the tube is coupled to a wheel so that the defensive line shoot drill apparatus 100 can move where needed. Further, the wheels lock for when a football player tackles the dummy 116. In this regard, leg 108 is coupled to wheel 117, leg 107 is coupled to wheel 118, leg 109 is coupled to wheel 119, leg 110 is coupled to wheel 120, leg 114 is coupled to wheel 121, and leg 115 is coupled to wheel 122. In one embodiment, all the wheels swivel thereby allowing a wide range of motion of the defensive line shoot drill apparatus 100. Further, the wheels lock when in use.

Note that each leg 108, 107, 119, 120, 121, and 122 are telescoping legs. This allows the defensive line shoot drill apparatus 100 to be placed higher or lower depending upon the application of the defensive line shoot drill apparatus 100.

Note that the defensive line shoot drill apparatus 100 may be disassembled for transport. In this regard, leg 190 may be separated from leg 123 at connection 125. In this regard, a pin may hold leg 109 to leg 123. When the pin is removed, 109 is removeable from leg 123. Further, leg 110 may be separated from leg 124 at connection 126. In this regard, a pin may hold leg 110 to leg 124. When the pin is removed, 110 is removeable from leg 124. Thus, the front, lower section 101 may be separated from the back, higher section 102 for transport or storage.

Figure 2:
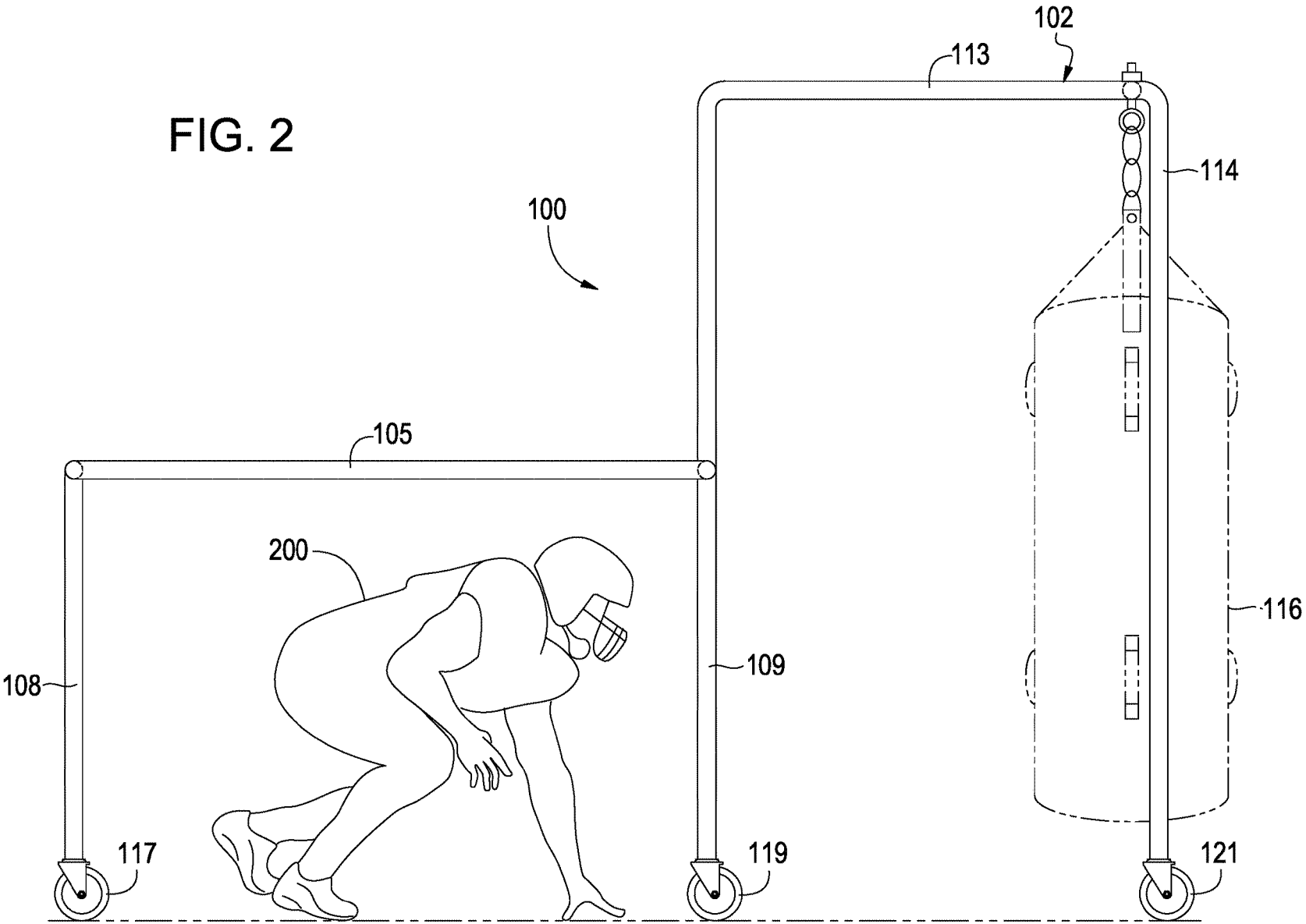
FIG. 2 is a side view of the defensive line shoot drill apparatus of FIG. 1 showing a football player in stance to use the defensive line shoot drill apparatus.

FIG. 2 is a side view of the defensive line shoot drill apparatus 100. The football player 200 lines up under the tubes 103 (FIG. 1), 104 (FIG. 1), 105, and 106 (FIG. 1) of the front, lower section 101. The football player 200 is also centrally located with respect to leg 107 (FIG. 1), 108, 109, and 110 (FIG. 1). The football player is in a three point stance and leaning forward on the balls of his feet. When the football player, aiming for the dummy 116, moves forward, he comes forward between the legs 109 and 110, hits the dummy low down on the dummy and pushes the dummy upward. This movement in the defensive line shoot drill apparatus 100 trains defensive linemen on how to tackle correctly with his arms.

Figure 3:
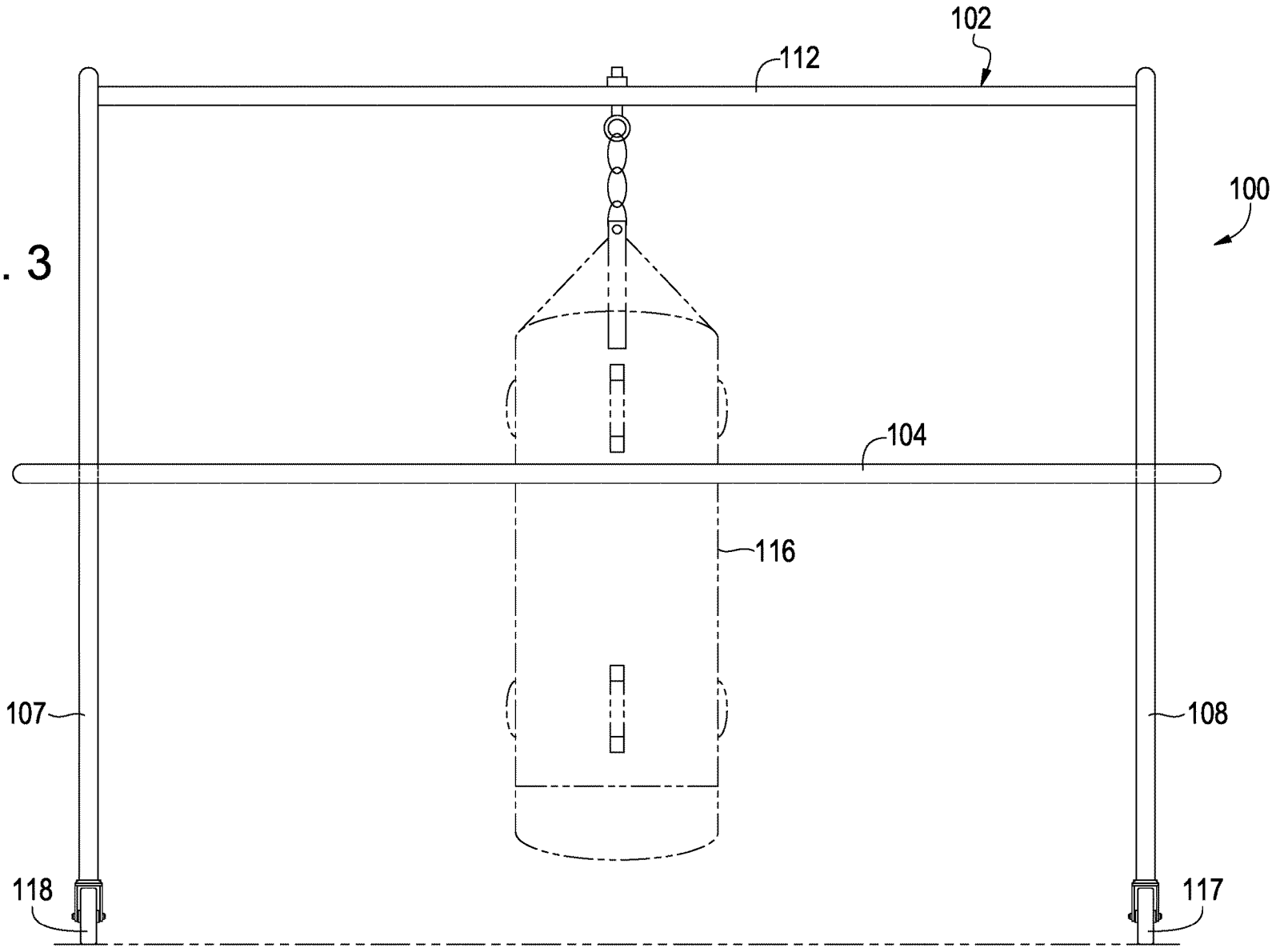
FIG. 3 is a front view of the defensive line shoot drill apparatus of FIG. 1.

FIG. 3 is a front view of the defensive line shoot drill apparatus 100. FIG. 3 shows the area between legs 107 and 108 between which the football player 200 (FIG. 2) stands in his three-point stance. The legs 107 and 108 have wheels 118, 117, respectively. The wheels 118, 117 swivel thereby allowing a wide range of motion of the defensive line shoot drill apparatus 100. Further, the wheels lock when in use.

Further, the football player 200 lines up in his stance under tube 104. The football player 200 moves forward and upward from his stance aiming for the dummy 116, which is attached to tube 112. This movement dictated by the shape of the defensive line shoot drill apparatus 100 helps football players learn to tackle effectively with his arms.

The invention claimed is:

1. An apparatus, comprising:

a front, lower section comprising a rectangular member, the rectangular member formed with two front-section, short parallel tubes coupled to two front-section, long parallel tubes;

a back, higher section coupled to the front, lower section, the back, higher section comprising two back-section, parallel short tubes coupled to one back-section long parallel tube forming a substantially U-shaped top, the back, higher section coupled to a dummy, such that a football player can strike a three-point stance under the front lower section, move outward and upward, and tackle the dummy, wherein the rectangular member is fixed vertically below the U-shaped member via legs extending downward from the U-shaped top and coupled to the rectangular member.

2. The apparatus of claim 1, wherein the front, lower section is cuboidal-shaped.

3. The apparatus of claim 1, wherein the two front-section, short parallel tubes are a left and a right parallel short tube, respectively, and the two front-section, long parallel tubes are a front and a back parallel long tube, respectively, and the two front-section, short parallel tubes are coupled to the two front-section, long parallel tubes at corners forming an open rectangle.

4. The apparatus of claim 3, wherein the front, lower section comprises two front legs, a first front leg coupled to the left, parallel short tube and a second front leg coupled to the right, short tube.

5. The apparatus of claim 4, wherein the first front leg and the second front leg have wheels on ends of the front first leg and the second front leg and the wheels swivel, further the wheels but lock when in use.

6. The apparatus of claim 1, wherein the back, higher section is elevated above the front, lower section.

7. The apparatus of claim 6, wherein the back, higher section comprises a back, left leg that couples to the front, lower section and a back, right leg that couples to the front, lower section.

8. The apparatus of claim 7, wherein the back, higher section comprises a back, left tube coupled to a top of the back, left leg.

9. The apparatus of claim 8, wherein the back, higher section comprises a back, right tube coupled to a top of the back, right leg.

10. The apparatus of claim 9, wherein the back, left tube and the back, right tube are parallel.

11. The apparatus of claim 10, wherein the back higher section comprises a connector tube that connects the back, left tube and the back, right tube.

12. The apparatus of claim 11, wherein the connector tube has a connector, back, left leg and a connector, back, right leg.

13. The apparatus of claim 12, wherein the back, left leg, the back, right leg, the connector, back, left leg, and the connector, back, right leg comprise wheels on their downward ends and the wheels swivel, further the wheels lock when in use.

* * * * *